United States Patent [19]

Hillman

[11] 4,285,079

[45] Aug. 25, 1981

[54] APPARATUS FOR RAISING AND LOWERING THE MATTRESS OF A CRIB

[76] Inventor: Ernest C. Hillman, 1277 S. Adams St., Glendale, Calif. 91205

[21] Appl. No.: 49,543

[22] Filed: Jun. 18, 1979

[51] Int. Cl.[3] ..... A61G 7/00; A47C 31/00; A47D 7/01

[52] U.S. Cl. ..... 5/84; 5/11; 5/93 R

[58] Field of Search ..... 5/93 R, 84, 85, 83, 5/88, 11, 81 R, 99 B

[56] References Cited

U.S. PATENT DOCUMENTS

| | | | |
|---|---|---|---|
| 982,807 | 1/1911 | Fravel | 5/84 |
| 1,227,301 | 5/1917 | Ogden | 5/85 |
| 1,511,477 | 10/1924 | Jepson | 5/84 |
| 1,588,573 | 6/1926 | Edmiston | 5/84 |
| 2,267,176 | 12/1941 | Turner | 5/11 |

*Primary Examiner*—Alexander Grosz
*Attorney, Agent, or Firm*—Fulwider, Patton, Rieber, Lee & Utecht

[57] ABSTRACT

A crib having a main frame, a generally horizontal mattress support, and a mattress carried by the support. The mattress and support can be raised and lowered within the main frame by flexible hoist members attached to a winding bar that is rotatably journaled in two housings. Each housing is elongated, extending across one end of the crib, the hoist members being threaded through the housings and attached to the winding bar. At their ends, the hoist members are secured by brackets to a spring frame that forms part of the mattress support. The brackets can be used with spring frames of a variety of constructions. They have an upwardly facing channel that can receive a tubular frame with radius corners and an adjacent slot that can receive a downwardly projecting flange.

12 Claims, 13 Drawing Figures

Fig. 1
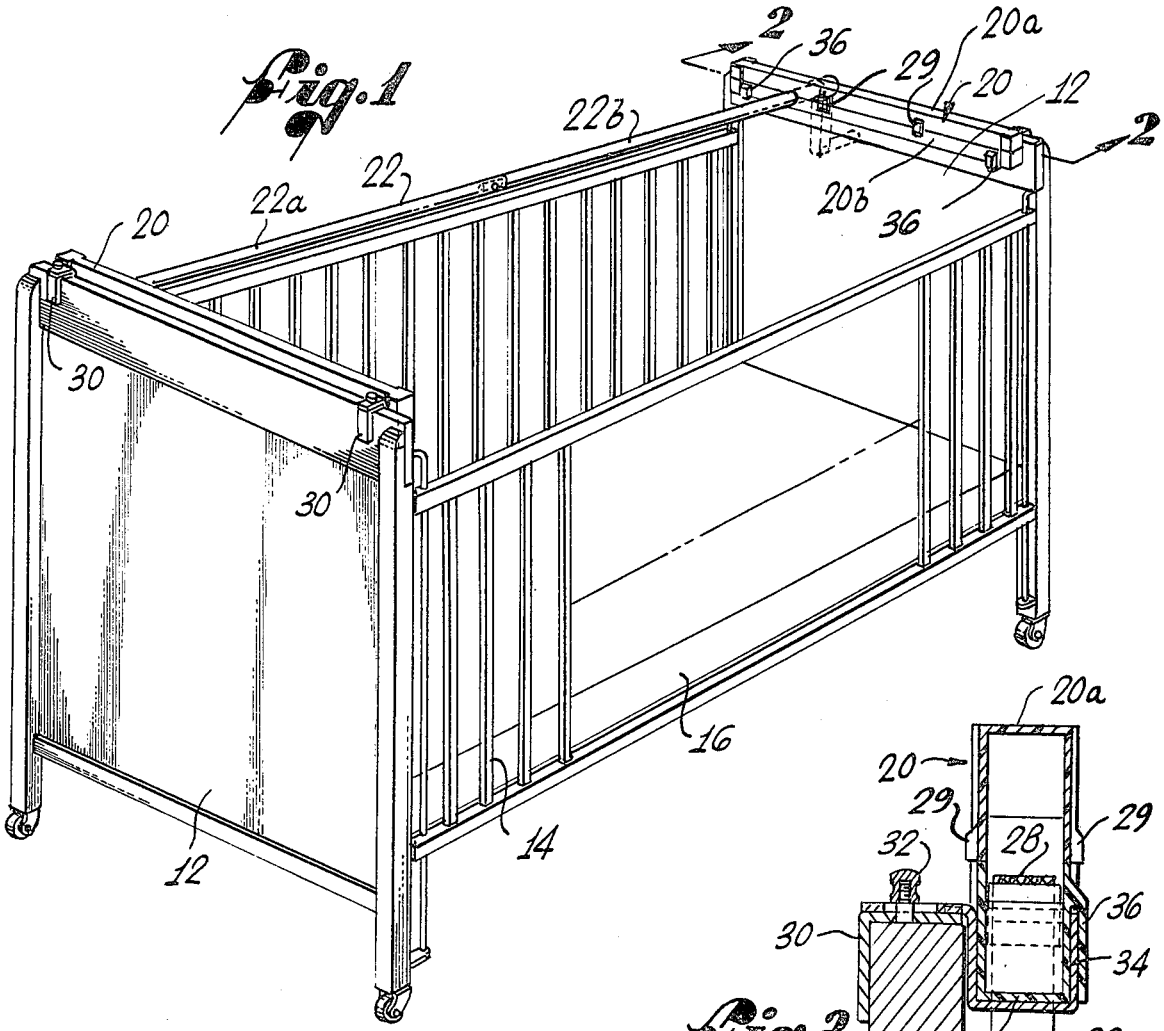
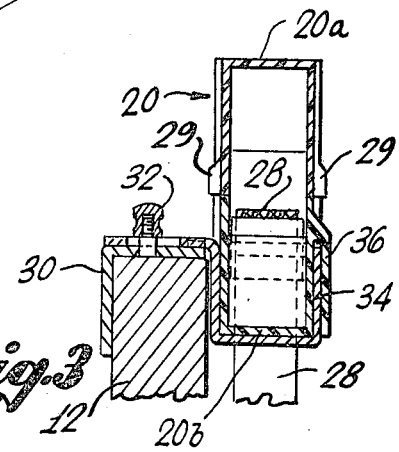
Fig. 3
Fig. 2
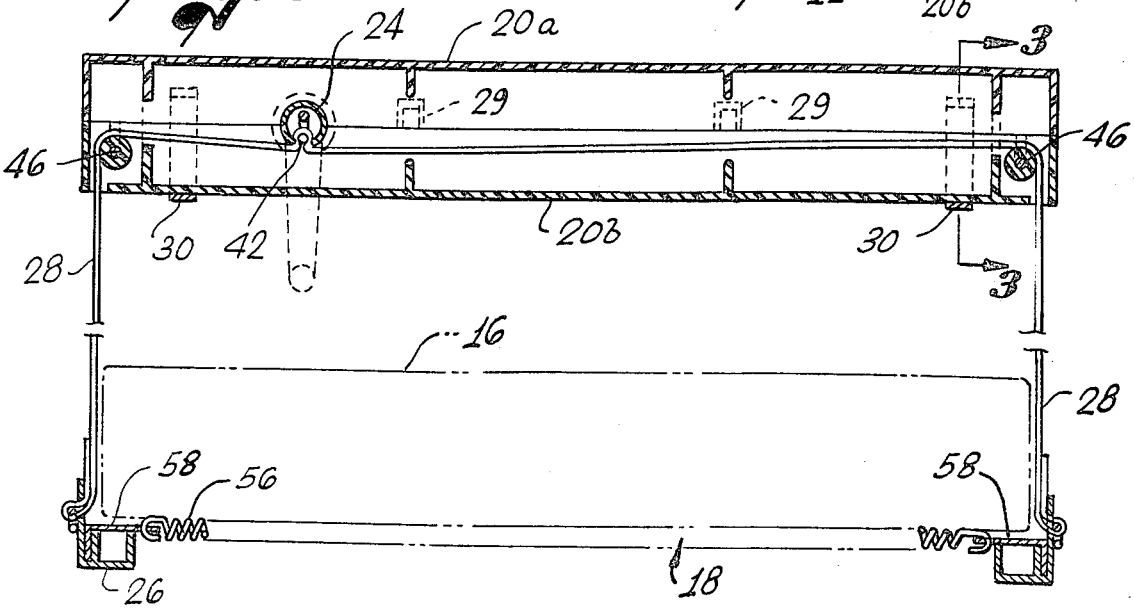

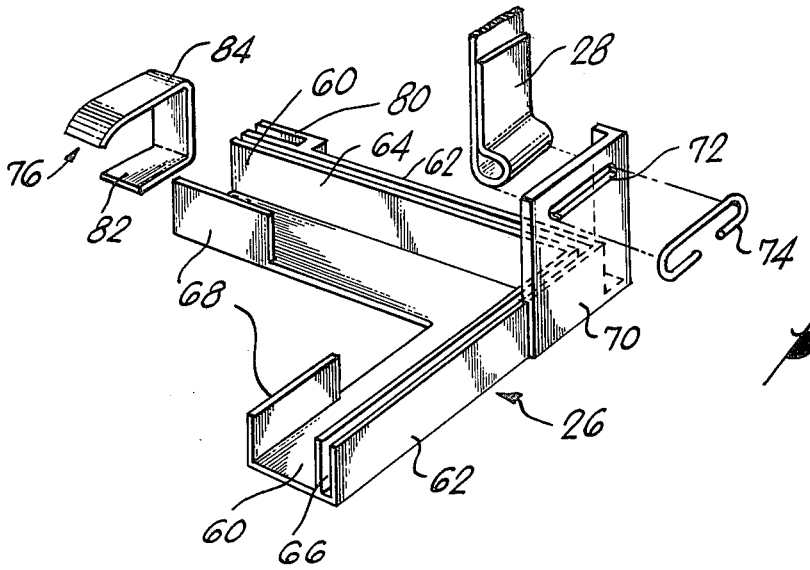
Fig. 9
Fig. 10
Fig. 11
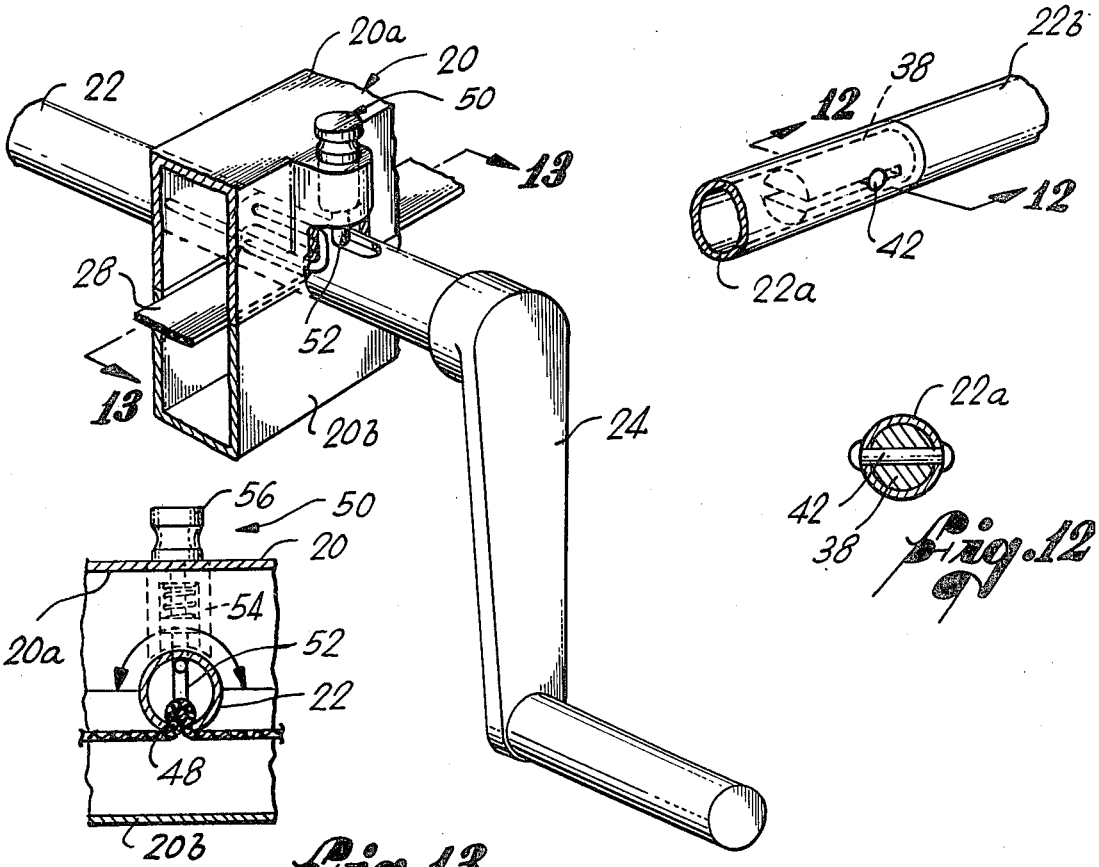
Fig. 12
Fig. 13

APPARATUS FOR RAISING AND LOWERING THE MATTRESS OF A CRIB

FIELD OF THE INVENTION

The present invention relates to cribs for infants, and, more particularly, to an arrangement for raising and lowering the mattress of such a crib.

BACKGROUND OF THE INVENTION

A conventional crib for an infant has a main frame consisting of a headboard and a footboard that form the ends and two parallel sides, usually having vertical bars with openings between them. A horizontal mattress support is positioned within this main frame and consists of a rectangular spring frame and springs on which a mattress rests extending horizontally across the main frame. It is usually possible to secure the mattress support to the main frame at a variety of discrete vertical levels. Generally, it is desirable to position the mattress support at a low enough level with relation to the top of the crib sides so that there is no danger of the child falling out. However, the lower the mattress, the more difficult it is to attend to a child in the crib or to change the bedding. There is, therefore, no one mattress position that is both safe and convenient.

It should be noted that raising and lowering the mattress is a difficult and awkward task requiring far too much time and effort to permit the mattress to be raised whenever the child requires attention or the bedding is to be changed. Instead, a suitable compromise level must be selected in view of the size of the child, and the mattress remains in that position.

It has long been recognized that it would be highly desirable if it were possible to quickly and easily raise the mattress when attending to the child or changing the bedding and to then lower it again. A variety of mechanisms have been proposed for this purpose but, these mechanisms have, in general, been characterized by a variety of disadvantages including undesirable complexity and expense or difficulty of operation.

Most such mechanisms that have been proposed require that they be built into the crib as it is originally manufactured and are, therefore, not suitable for the large number of cribs currently in use. One important reason for the lack of adaptability of these mechanisms to existing cribs relates to the variety of constructions of the spring frames, some of which are tubular having radius corners while others are fabricated of right angle pieces that form sharp corners.

It is an objective of the present invention to provide an improved mechanism for raising and lowering the mattress of the crib that is of reduced complexity and expense but is, nevertheless, easily and conveniently operated. Another objective is to provide such mechanism that can be used with a wide variety of cribs of different sizes and having different spring frame configurations.

SUMMARY OF THE INVENTION

According to the present invention, the spring frame of a crib is received and supported by a plurality of brackets and flexible hoist members which connect the brackets to a hoisting mechanism mounted above the mattress on the main frame of the bed. The hoisting mechanism can include a winding bar that extends between the two ends of the main frame, with the hoist members secured to the brackets at their opposite ends and to the winding bar at intermediate points. Rotation of the winding bar will wind or unwind the hoist members to raise or lower the mattress support.

According to one aspect of the invention, the winding bar is rotatably supported by a pair of hangers each of which extends along one end of the main frame where it is releasably secured by clamps. Preferably, these hangers are formed by elongated, enclosed housings with the hoist members threaded through the housings to the winding bar. A crank is provided to rotate the winding bar and a latch mechanism is used to prevent its rotation.

Another aspect of the invention relates to the brackets which are capable of use with spring frames of a variety of constructions. Each bracket includes a bottom plate and inner and outer walls that define an upwardly facing channel in which the spring frame is received, the channel having two sections at right angles to each other to receive a corner of the spring frame. The inner wall is formed by two separated parts each terminating at a distance from the intersection of the channel sections to accommodate a spring frame having radius corners. The outer walls are formed by two slightly spaced parallel partitions that define an upwardly facing slot between them that can, in the case of a non-tubular frame, receive a downwardly projecting flange on the frame's perimeter.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of an infant's crib constructed in accordance with the present invention;

FIG. 2 is an enlarged cross-sectional view of the crib taken as indicated by the line 2—2 of FIG. 1, showing only the mattress raising and lowering mechanisms;

FIG. 3 is an enlarged fragmentary cross-sectional view of one housing taken as indicated by the line 3—3 of FIG. 2;

FIG. 9 is a fragmentary, top view, on a smaller scale, of a larger portion of the spring frame of FIG. 7;

FIG. 10 is an enlarged, perspective, fragmentary view of the crank of FIG. 1;

FIG. 11 is an enlarged, fragmentary, perspective view of a mid-section of the winding bar;

FIG. 12 is a cross-sectional view of the winding bar taken along the line 12—12 of FIG. 11; and FIG. 13 is a fragmentary, cross-sectional view of the winding bar and latch mechanism taken along the line 13—13 of FIG. 10.

DESCRIPTION OF THE PREFERRED EMBODIMENT

Figure 4:
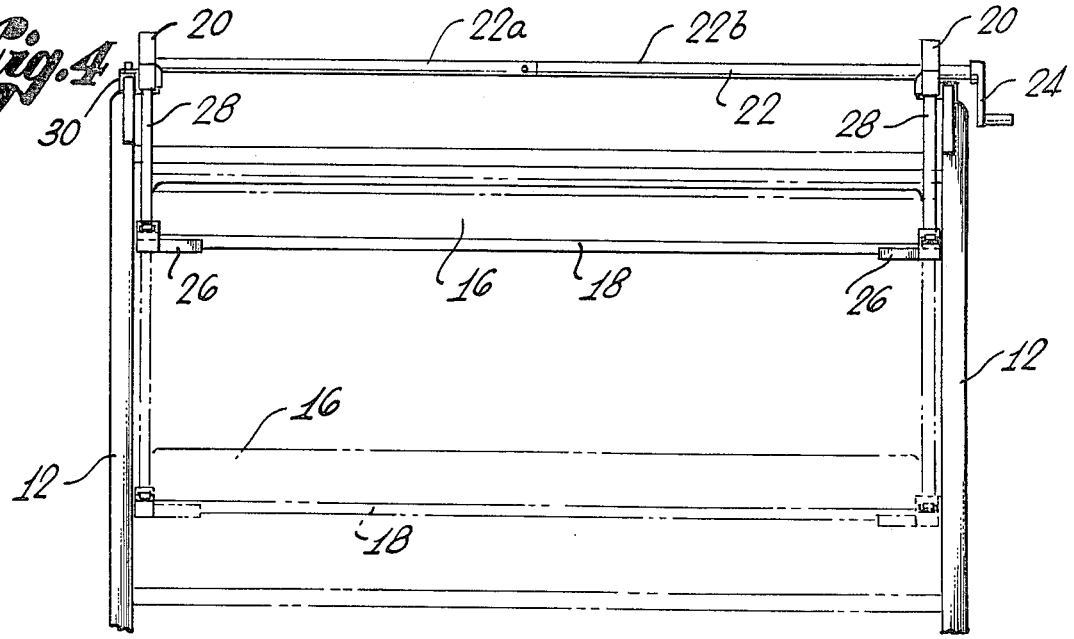
FIG. 4 is a partially schematic side elevation of the crib of FIG. 1, showing the mattress in solid lines in a raised position and in phantom lines in a lowered position.
Figure 5:
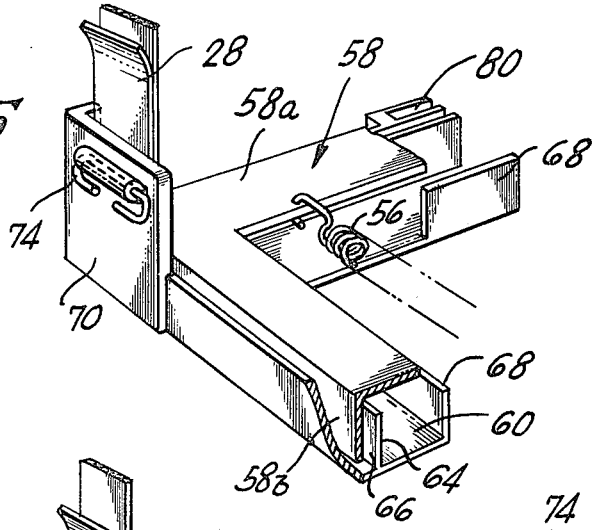
FIG. 5 is an enlarged, perspective view of a bracket receiving a fragmentary portion of a non-tubular spring frame of a mattress support.

The present invention is explained with reference to an exemplary crib 10, shown in FIG. 1. It has a main frame that includes a headboard 12 and a footboard 13, forming ends connected by a pair of parallel sides with closely spaced vertical bars 14. A mattress 16, carried by a horizontal mattress support 18, is positioned within the main frame as best shown in FIGS. 2 and 4. A hoisting mechanism permits the mattress 16 to be raised and lowered at will, the mattress being shown in FIG. 4 in solid lines in a raised position and in phantom lines in a lowered position.

In general, the hoisting mechanism includes a pair of hangers 20 disposed at the ends 12 and 14 of the crib 10, a winding bar 22 extending between the hangers, a crank 24 for turning the winding bar, a set of four brackets 26 that engage the mattress support 18 at its corners, and a pair of straps 28, in the form of nylon belts and referred to as flexible hoist members, connecting the brackets to the winding bar.

The hangers 20 each have the configuration of an elongated box-like housing with separable top and bottom halves, **20*a* and 20*b*, respectively, joined by releasable fasteners 29 (See FIGS. 1 and 2). They are short enough that they can be installed in most cribs, a space between the end of the housing 20 and the end of the crib end 12 or 14 being acceptable in the case of larger cribs. The bottom half 20*b* is releasably secured to the top of the adjacent end 12 or 14 by a pair of downwardly facing, U-shaped clamps 30. The horizontal width of each clamp 30 is adjustable, upon loosening a set screw 32 (as best shown in FIG. 3) to accommodate the differently dimensioned ends of a variety of cribs. On the inside of the crib end 12, the clamp 30 carries an upwardly facing channel in which the bottom 20*b* of the housing 20 is securely received, an innermost vertical wall 34 of the bracket being tightly inserted in a downwardly facing pocket 36** on the housing.

Once the two bottom halves **20*b* are in position, the winding bar 22 is nested within the housing 20 so that it extends the length of the crib, substantially off-center where it is out of the way and parallel to the side 14. The top halves 20*a*** are then installed.

The winding bar 22 is formed of two separate pieces **22*a* and 22*b* so that it will be compact upon disassembly. The end of one piece 22*b* is attached to the crank 24 and carries a projection 38 of lesser diameter having a crosswise slot 40. The projection 38 fits into the adjacent end of the other piece 22*a* where the two pieces meet and a diametrical pin 42 carried by the other piece 22*a* is received by the slot 40. In this way the two pieces of the winding bar 22 are interlocked for joint rotation. The pin 42 can assume any position desired within the slot 40 to give the bar 22** the necessary overall length.

Each of the two straps 28 is threaded through one of the housings 20, entering and leaving the housing through a pair of slots 44 formed in its bottom surface near its outer ends. Accordingly, each strap 28 extends horizontally across the interior of its housing 20 and turns downwardly at either of the sides of the crib 10 on a supporting roller 46 mounted in the housing. At an intermediate point where it passes under the winding bar 22, the strap 28 is secured to the bar by inserting it in a slot in the bottom of the bar around a pin 48, and back out through the slot (see FIGS. 2 and 13). It is noted that rotating the bar 22 will cause it to wind the strap 28, thus raising both ends of the strap simultaneously. Rotation of the bar 22 in the opposite direction will unwind the strap 22 and lower the ends.

To prevent undesired rotation of the winding bar 22, a latch 50 is mounted on the housing 20 adjacent the crank 24, as best shown in FIG. 10. It includes a downwardly biased, vertically reciprocable latch pin 52 that, in its normal latched position, projects through an aperture in the bar 22 and the mating portion of the crank 24. When it is desired to turn the crank 24, the latch pin 52 is lifted against the force of a spring 54 by pulling upwardly on a knob 56.

Figure 6:
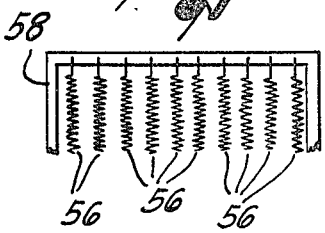
FIG. 6 is a fragmentary, top view, on a smaller scale, of a larger portion of the spring frame of FIG. 5.
Figure 7:
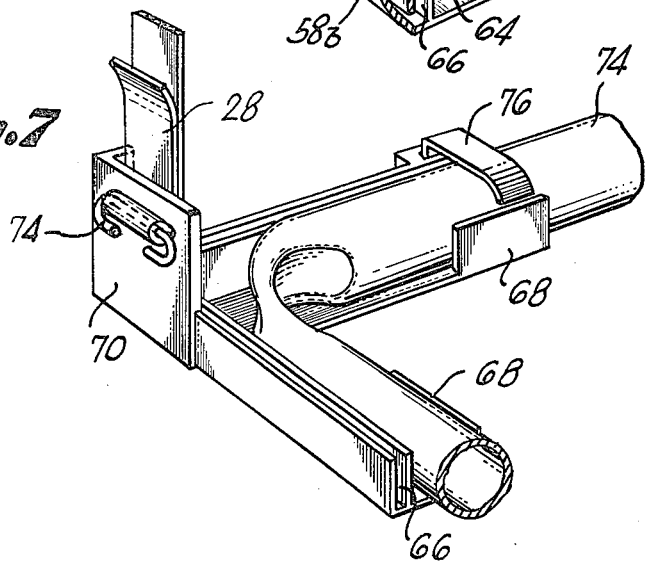
FIG. 7 is an enlarged prospective view of the same bracket shown in FIG. 5 receiving a fragmentary portion of a tubular spring frame.

A unique feature of the invention is that the brackets 26 by which the ends of the straps 28 are connected to the mattress support 18 are capable of receiving supports of a variety of configurations so that the hoisting mechanism can be made and sold separately and used with many different cribs. The crib 10 is first assumed to have a mattress support 18 of a common type, shown in FIG. 6, in which a plurality of springs 56 are connected to a square cornered rectangular perimetrical spring frame 58, each of the four sides of the frame consisting of a flat horizontal plate **58*a* from which a vertical plate 58*b*** projects downwardly along its outer edge.

The bracket 26 consists of two generally U-shaped sections, each of which forms an upwardly facing channel 60, the channel sections intersecting to form a right angle corner. The outer wall of the bracket 26 is formed by two closely spaced parallel partitions 62 and 64 which define an upwardly facing slot 66 between them, as best shown in FIG. 9. The inside of the channel 60 is defined by an inner wall 68 which is in two short parts that do not extend all the way to an intersection at the corner, for reasons that will be explained below.

A corner of the spring frame 58 is aligned with the bracket 26 and the downwardly projecting flanges **58*b* are received by the slot 66 of the bracket. With the mattress support 58 held in this manner at each of four corners, it is securely suspended within the main frame of the crib 10. An upright projection 70 extending above the outer sidewall 62 of the bracket 26 is secured directly to the end of the strap 28. A portion of the strap 28 is pressed through a slot 72 in the projection 70 and an elongated C-shaped clip 74 engages the strap to prevent it from passing back out through the slot. By pulling the free end of the strap 28 through the clip 74**, the length of the strap can be adjusted to fit the dimensions of the particular crib.

Figure 8:
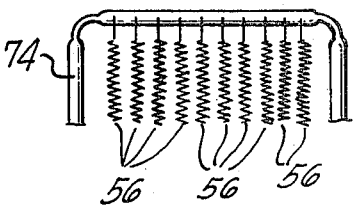
FIG. 8 is an exploded view of a similar bracket for use on the opposite corner of the spring frame.

The same bracket 26 is usable with a differently configured spring frame 72 shown in FIG. 8, which is formed by a single tubular member 74 bent into a generally rectangular shape having round corners. Instead of interlocking with the slot 66, this tubular member 74 rests in the larger channel 60. Since, as explained above, the inner walls of the channel 60 do not intersect but leave a gap between them, the curvature of the tubular member 74 is accommodated.

The tubular member 74 is further secured by a clip 76 having a vertical portion 78 received by a slot 80 on the outside of the bracket 26. At the bottom of the clip, an arm 82 extends beneath the bracket 26 and, at the top, a longer arm 84 extends over the tubular member 74, the outer end of the upper arm being bent downwardly to embrace the tubular member and prevent it from shifting.

It will be noted from the above description that the present invention provides a hoisting mechanism that can be used in combination with a wide variety of differently constructed cribs and can be manufactured and sold separately from the cribs. Nevertheless, the entire mechanism is simple and easily installed. The mattress 16 is securely held at any level chosen and there is a minimum of friction when the mattress is being raised or lowered. It should be particularly noted that a variety of rather different mattress supports can be accommodated by the unique construction of the brackets 26.

While particular forms of the invention have been illustrated and described, it will also be apparent that various modifications can be made without departing from the spirit and scope of the invention.

I claim:

1. An attachment for use with a crib having a main frame including a pair of opposing ends and a pair of sides connecting said ends, a mattress support including a spring frame and a plurality of springs, and a mattress carried by said mattress support, said attachment comprising:

a plurality of brackets in which said spring frame can be received, each of said brackets including a bottom plate and inner and outer walls that define a channel so that it has two sections at right angles, to each other to receive a corner of said spring frame, said inner wall having two separate parts that each terminate at a distance from the intersection of said channel sections, whereby said brackets can accommodate a spring frame having round corners;

a plurality of flexible hoist members for connection to said brackets; and winding means connected to said hoist members for raising and lowering said mattress support.

2. The attachment of claim 1 wherein said outer wall is formed by two parallel, slightly spaced partitions defining a slot therebetween to receive a downwardly projecting flange on said spring frame.

3. The attachment of claim 1 further comprising:

a pair of hangers in which said winding bar is supported at its ends; and clamp means for securing said hangers to said ends of said main frame.

4. The attachment of claim 3 wherein each of said hangers comprises an elongated, enclosed housing in which said winding bar is rotatably journaled, said hoist members being threaded through said housings to said winding bar.

5. An attachment for use with a crib having a main frame including a pair of opposing ends and a pair of sides connecting said ends, a mattress support including a spring frame and a plurality of springs, and a mattress carried by said mattress support, said attachment comprising:

a plurality of flexible hoist members;

means for connecting said hoist members to said spring frame;

winding means connected to said hoist members for raising and lowering said mattress support;

a pair of elongated enclosed housings located at said ends of said frame in which said winding bar is journaled and rotatably supported at its ends, said hoist members being threaded through said housings to said winding bar; and means for securing said housings to said ends of said main frame.

6. A crib with an adjustably positioned mattress comprising:

a main frame including a pair of opposing ends and a pair of sides connecting said ends;

a generally horizontal mattress support disposed within said main frame;

a mattress carried by said support;

a winding bar extending between said ends and over said mattress;

a pair of flexible hoist members each of which is disposed near one of said ends and secured to said mattress support and to said winding bar, whereby said hoist members can be wound onto said winding bar and unwound therefrom by rotating said winding bar;

crank means for rotating said winding bar, and a pair of elongated enclosed housings each of which extends along one of said ends of said main frame, said winding bar being journaled in and rotatably supported by said housings at its ends, said hoist members each being connected at their ends to said mattress support and being threaded through one of said housings to said winding bar.

7. The crib of claim 6 further comprising latch means for preventing rotation of said winding bar.

8. The crib of claim 6 wherein said housings are box-like, each having a bottom with at least two slots therein through which said hoist members are received.

9. A crib with an adjustably positioned mattress comprising:

a main frame including a pair of opposing ends and a pair of sides connecting said ends;

a generally horizontal mattress support disposed within said main frame;

a mattress carried by said support;

a winding bar extending between said ends and over said mattress;

a pair of flexible hoist members each of which is disposed near one of said ends and secured to said mattress support and to said winding bar, whereby said hoist members can be wound onto said winding bar and unwound therefrom by rotating said winding bar;

crank means for rotating said winding bar; and a plurality of brackets by which said hoist members are connected to said mattress support, said mattress support including a generally rectangular spring frame and a plurality of springs connected to said spring frame, said brackets each defining an upwardly facing channel in which said spring frame is received.

10. The crib of claim 9 wherein each of said brackets includes a bottom plate and inner and outer walls that define said channel so that it has two sections at right angles to each other to receive a corner of said spring frame, said inner wall including two separated parts that each terminate at a distance from the intersection of said channel sections, whereby said brackets can accommodate a spring frame having round corners.

11. A crib with an adjustably positioned mattress comprising:

a main frame including a pair of opposing ends and a pair of sides connecting said ends;

a generally horizontal mattress support disposed within said main frame;

a mattress carried by said support and including a generally rectangular spring frame with a downwardly projecting flange;

a winding bar extending between said ends and over said mattress;

a pair of flexible hoist members each of which is disposed near one of said ends and secured to said mattress support and to said winding bar, whereby said hoist members can be wound onto said winding bar and unwound therefrom by rotating said winding bar;

crank means for rotating said winding bar; and a plurality of brackets by which said hoist members are connected to said mattress support, said brackets defining upwardly facing slots in which said flange is received.

12. A crib for an infant comprising:

a main frame including a pair of opposing ends and a pair of sides connecting said ends;

a generally horizontal mattress support including a generally rectangular spring frame and a plurality of springs attached to said spring frame;

a mattress carried by said support;

a winding bar;

a pair of elongated enclosed housings each of which extends along the top edge of one of said main frame ends, said winding bar being rotatably journaled at its ends in said housings;

a plurality of clamp means for releasably securing said housings to the top edges of said main frame ends;

a plurality of brackets each including a bottom plate and inner and outer walls defining an upwardly facing channel that has two sections at right angles to each other to receive a corner of said spring frame, said inner wall including two separated parts that each terminate at a distance from the intersection of said channel sections to accommodate a spring frame having round corners;

a pair of flexible straps each of which is secured at each of its two opposite ends to one of said brackets, being threaded through one of said housings and secured at an intermediate point to said winding bar;

crank means for rotating said winding bar to selectively wind or unwind said hoist members; and latch means for preventing rotation of said winding bar.

* * * * *